US007844764B2

(12) United States Patent
Williams

(10) Patent No.: US 7,844,764 B2
(45) Date of Patent: Nov. 30, 2010

(54) UNITARY CONTROL MODULE WITH ADJUSTABLE INPUT/OUTPUT MAPPING

(75) Inventor: Eric B. Williams, Tallmadge, OH (US)

(73) Assignee: Honeywell International Inc., Morristown, NJ (US)

( * ) Notice: Subject to any disclaimer, the term of this patent is extended or adjusted under 35 U.S.C. 154(b) by 383 days.

(21) Appl. No.: 11/865,125

(22) Filed: Oct. 1, 2007

(65) Prior Publication Data

US 2009/0088902 A1 Apr. 2, 2009

(51) Int. Cl.

| | |
|---|---|
| ***G06F 13/12*** | (2006.01) |
| ***G06F 13/38*** | (2006.01) |
| ***G06F 3/00*** | (2006.01) |
| ***G06F 9/455*** | (2006.01) |
| ***G05B 11/01*** | (2006.01) |
| ***G05B 21/00*** | (2006.01) |
| ***G05B 13/00*** | (2006.01) |
| ***G05B 15/00*** | (2006.01) |
| ***G01M 1/38*** | (2006.01) |
| ***G05D 23/00*** | (2006.01) |

(52) U.S. Cl. ..... 710/63; 710/3; 710/5; 710/8; 710/64; 710/72; 700/19; 700/25; 700/278; 703/25; 703/28

(58) Field of Classification Search ..... 700/3, 700/11, 19, 20, 23–25, 86, 89, 278; 702/31, 702/188; 703/23–25, 28; 710/3–5, 8–10, 710/62–65, 69, 72–74

See application file for complete search history.

(56) References Cited

U.S. PATENT DOCUMENTS

| | | | | |
|---|---|---|---|---|
| 4,072,380 | A | 2/1978 | Freehauf | |
| 4,401,353 | A | 8/1983 | McDevitt, Jr. et al. | |
| 4,426,850 | A | 1/1984 | Reedy | |
| 4,540,226 | A | 9/1985 | Thompson et al. | |
| 4,609,241 | A | 9/1986 | Peterson | |
| 4,788,520 | A | 11/1988 | Strand | |
| 5,039,009 | A | 8/1991 | Baldwin et al. | |
| 5,299,113 | A | 3/1994 | England et al. | |
| 5,373,470 | A | 12/1994 | Jones, Jr. | |
| 5,376,930 | A | 12/1994 | Merkle et al. | |
| 5,473,229 | A * | 12/1995 | Archer et al. | 318/400.18 |

(Continued)

OTHER PUBLICATIONS http://www.precicontact.ch/uso%20so%20socket.htm, Precicontact, Dip Socket, 4 pages, printed Mar. 5, 2003.

(Continued)

*Primary Examiner*—Crystal J Barnes-Bullock
(74) *Attorney, Agent, or Firm*—Crompton Seager & Tufte LLC

(57) ABSTRACT

A unitary control module having adjustable input and output mapping functionality, including methods of configuring such devices for use in different applications, are disclosed. The unitary control module can include a unit type selector such as a DIP-switch that can be used by an installer to configure the control module to emulate a particular type of controller. The control module can be configured to run a selection algorithm for configuring the mapping of the input terminals and output terminals for the device based on the controller type selected. In use, the control module may run different control algorithms for controlling the system components based on the controller type selected.

16 Claims, 6 Drawing Sheets

U.S. PATENT DOCUMENTS

| | | | | |
|---|---|---|---|---|
| 5,530,643 | A * | 6/1996 | Hodorowski | 700/86 |
| 5,572,409 | A | 11/1996 | Nathan et al. | |
| 5,673,418 | A * | 9/1997 | Stonier et al. | 703/23 |
| 5,721,737 | A * | 2/1998 | Radjabi et al. | 370/449 |
| 5,726,482 | A | 3/1998 | Nathan et al. | |
| 5,727,170 | A | 3/1998 | Mitchell et al. | |
| 5,754,823 | A | 5/1998 | Mudryk, Jr. et al. | |
| 5,806,760 | A | 9/1998 | Maiello | |
| 5,917,229 | A | 6/1999 | Nathan et al. | |
| 5,920,731 | A | 7/1999 | Pletl et al. | |
| 5,950,709 | A | 9/1999 | Krueger et al. | |
| 5,958,026 | A | 9/1999 | Goetting et al. | |
| 6,000,458 | A | 12/1999 | Watanabe | |
| 6,029,092 | A * | 2/2000 | Stein | 700/11 |
| 6,169,937 | B1 | 1/2001 | Peterson | |
| 6,289,409 | B1 | 9/2001 | Bacigalupo | |
| 6,308,231 | B1 | 10/2001 | Galecki et al. | |
| 6,363,137 | B1 * | 3/2002 | Nakao et al. | 379/1.01 |
| 6,401,139 | B1 | 6/2002 | Hamilton et al. | |
| 6,445,242 | B2 | 9/2002 | Bloodworth et al. | |
| 6,505,245 | B1 * | 1/2003 | North et al. | 709/223 |
| 6,564,561 | B2 * | 5/2003 | Daum et al. | 62/130 |
| 6,618,628 | B1 * | 9/2003 | Davlin et al. | 700/3 |
| 6,725,281 | B1 * | 4/2004 | Zintel et al. | 719/318 |
| 6,728,258 | B1 * | 4/2004 | Okada et al. | 370/463 |
| 6,825,689 | B1 | 11/2004 | Snyder | |
| 6,832,185 | B1 * | 12/2004 | Musselman et al. | 703/23 |
| 6,870,397 | B1 | 3/2005 | Fox et al. | |
| 6,888,441 | B2 | 5/2005 | Carey | |
| 7,034,570 | B2 | 4/2006 | McClintock et al. | |
| 7,044,397 | B2 | 5/2006 | Bartlett et al. | |
| 7,068,164 | B1 * | 6/2006 | Duncan et al. | 340/539.16 |
| 7,085,814 | B1 * | 8/2006 | Gandhi et al. | 709/208 |
| 7,208,975 | B1 | 4/2007 | Agrawal et al. | |
| 7,287,189 | B1 | 10/2007 | Johnson et al. | |
| 7,330,919 | B2 * | 2/2008 | Zhang et al. | 710/72 |
| 7,499,810 | B1 * | 3/2009 | Walker | 702/31 |
| 2004/0238651 | A1 | 12/2004 | Juntunen et al. | |
| 2005/0192790 | A1 * | 9/2005 | Endo et al. | 703/25 |
| 2006/0004492 | A1 | 1/2006 | Terlson et al. | |
| 2006/0277027 | A1 * | 12/2006 | Mann et al. | 703/25 |
| 2008/0046227 | A1 * | 2/2008 | Flamingo | 703/28 |
| 2009/0082047 | A1 * | 3/2009 | Phillips et al. | 455/517 |

OTHER PUBLICATIONS

Honeywell, 7800 Series, "The Burner Control Family for Your Boiler, Your Baker, Your Hot Water Maker," 2 pages, Dec. 1995.

Honeywell, 7800 Series EC7810A, EC7820A Relay Modules, Specification Data, 8 pages, Mar. 1998.

Honeywell, 7800 Series Q7800 A,B 22-Terminal Universal Wiring Subbase, Product Data, 8 pages, Nov. 1998.

Honeywell, 7800 Series S7830 Expanded Annunciator, 12 pages, Jun. 1992.

Novar, "Unitary Control Module (UCM)," 2 pages, Jan. 15, 2007.

Novar, "Unitary Control Module (UCM), Executive Summary" 2 pages, Jan. 15, 2007.

Novar, "Unitary Control Module (UCM), Installation Instructions," pp. 1-10, Dec. 11, 2006.

* cited by examiner

UNITARY CONTROL MODULE WITH ADJUSTABLE INPUT/OUTPUT MAPPING

FIELD

The present disclosure relates generally to the field of controllers. More specifically, the present disclosure pertains to control modules having adjustable input/output mapping functionality and methods of configuring such devices for use in different applications.

BACKGROUND

Control modules are frequently used in controlling various aspects of a climate control system. In HVAC applications, for example, such control modules are often employed to provide control over a furnace, air-conditioner, heat pump, ventilation fan, damper valve, or other system component. In some cases, the control module may be used in conjunction with one or more other controllers as part of a networked HVAC system. For instance, the control module may be connected to an executive controller that provides executive control over several control modules each tasked to provide control over a particular system such as a heating system or ventilation system.

The control over each system often requires the use of a separate control module having a specific hardware and software configuration adapted to control the particular component or components within the system. In the control of a ventilation system, for example, a separate ventilation control module adapted to function with the various ventilation components (e.g. fans, damper valves, etc.) must typically be installed. In replacement applications where an existing controller is being replaced, there are often multiple reprogramming and/or downloading steps that are required to properly configure the control module for use with the existing system components. The modification of the control module may require, for example, the installer to download new software and physically rewire the input and output terminals on the device. Due to the number of variations in system components, the manufacturer of such control modules must often produce and stock numerous control module configurations, resulting in increased cost and overhead. Accordingly, there is a need for a unitary control module that can be configured to operate in different applications.

BRIEF SUMMARY

The present disclosure pertains to unitary control modules having adjustable input/output mapping functionality and methods of configuring such devices for use in different applications. A unitary control module in accordance with an illustrative embodiment can include an input interface having one or more input terminals, an output interface having one or more output terminals, and a unit type selector switch that can be used to configure the control module to emulate a particular controller type based on a particular controller type setting. The control module can include a processor adapted to run a selection algorithm for configuring the mapping of the input terminals and output terminals based at least in part on the controller type setting selected. In use, the control module may run different control algorithms based on the particular controller type selected. In certain embodiments, for example, the control module can be configured to emulate a ventilation controller, an electronic thermostat controller, a heat pump controller, or a custom controller. Other type of controllers can also be emulated depending on the particular application.

DETAILED DESCRIPTION

The following description should be read with reference to the drawings, in which like elements in different drawings are numbered in like fashion. The drawings, which are not necessarily to scale, depict illustrative embodiments and are not intended to limit the scope of the disclosure. Although examples of various elements are illustrated in the views, those skilled in the art will recognize that many of the examples provided have suitable alternatives that can be utilized. Moreover, while the various devices, algorithms, and methods herein are described for use in HVAC systems, it should be understood that the present invention can be employed in the control of other types of systems. Examples of other types of systems can include, but are not limited to, security systems, automation systems, sprinkler systems, and lighting systems.

Figure 1:
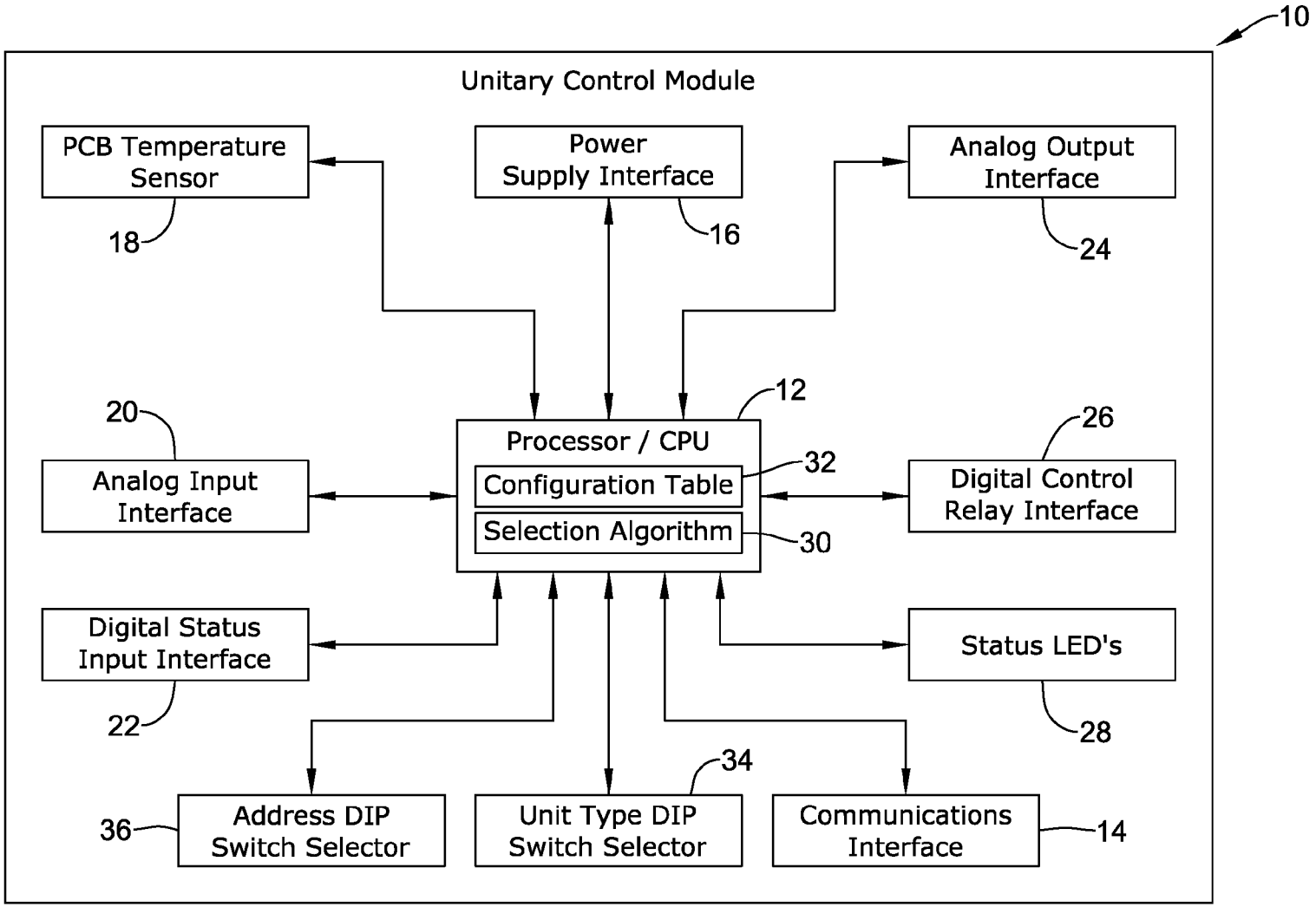
FIG. 1 is a diagrammatic view of an illustrative unitary control module.

Referring now to FIG. 1, a diagrammatic view of an illustrative unitary control module 10 will now be described. The control module 10 can include a processor 12 (e.g. a microprocessor/CPU) which, as discussed in greater detail herein, may run a selection algorithm 30 used to configure the module 10 to emulate a particular type or model of controller based on a code set via a unit type selection switch 34. The control module 10 can be utilized in new installations, or alternatively, can be provided as a drop-in replacement for an existing controller. In some embodiments, for example, the control module 10 can be configured to function as a new or replacement ventilation controller, electronic thermostat controller, heat pump controller, or other type of HVAC controller.

During installation, the various inputs and outputs for the control module 10 can be configured to match the hardware and software configurations for the particular type of unitary equipment that is to be controlled by the module 10. In those applications where the control module 10 is to function as an electronic thermostat controller (ETC), for example, the module 10 can be configured to emulate the software and hardware settings for the particular type and/or model of ETC that is being replaced. This adjustability allows the control module 10 to be used as a drop-in replacement in a variety of different applications. Examples of unitary equipment that can be controlled by the control module 10 can include, but are not limited to, package rooftop HVAC units, unit ventilators, heat pumps, and package dehumidification units.

The control module 10 can include a communications interface 14 for providing network communications between the module 10 and any other devices connected to the module 10. In some embodiments, for example, the communications interface 14 can be used to network the control module 10 with an executive controller tasked to provide executive control over the entire HVAC system. A power supply interface 16 may provide 24VAC power to the control module 10 for powering the module 10 and, in some cases, other control modules and/or devices connected to the module 10. A printed circuit board temperature sensor 18 (e.g. an on-board thermistor) may be used to monitor the internal temperature within control module 10.

An analog input interface 20 can be used to connect various sensors and/or other system components to the control module 10 as well as to make adjustments to the operation of the control module 10. The analog input interface 20 can include, for example, sensor input connections for connecting various sensors to the control module 10, an override input connection for overriding the operation of the module 10, and a setpoint adjustment connection to permit remote setpoint control adjustments to be made from another device and/or controller. Examples of sensor inputs that can be connected via the analog input interface 20 can include, but are not limited to, a zone air temperature sensor input connection for sensing air temperature within a zone, and a discharge air temperature sensor input connection for sensing air temperature within a discharge location such as in an air supply duct. An example setpoint adjustment connection can include a connection to an adjustment potentiometer used by the control module 10 for remotely adjusting the control setpoints.

A digital status input interface 22 can be configured to connection various digital inputs to the control module 10. Examples of digital inputs that can be provided via the interface 22 may include, but are not limited to, a fan status input for monitoring the status of a fan, and a dirty filter status input for monitoring the status of a filter. An override input may permit a momentary contact switch equipped with an LED to be used as an override indicator. For example, the override input may comprise a temperature sensor that acts as an override switch in the event the temperature exceeds a certain threshold. Other digital status inputs can also be provided via the interface 22, if desired. For example, the digital status input interface 22 may include a connection for monitoring the operational status and health of another control device and/or sensor connected to the control module 10.

The control module 10 can be configured to output various output signals based at least in part on the various analog and digital inputs received via the analog input interface 20 and the digital status input interface 22. An analog output interface 24 may permit, for example, the output of a 0-10VDC analog signal that can be used in controlling a damper, heating unit, cooling unit, or other HVAC system component. A digital control relay interface 26, in turn, provides various relay outputs that can be used to selectively activate various HVAC system components. Examples of digital relay outputs can include, but are not limited to, a fan relay output, a primary cooling relay output, a secondary cooling relay output, a primary heating relay output, an auxiliary heating relay output, and a damper relay output. A number of status LED's 28 can be used to provide a visual indication of the operating status of each relay. If, for example, a particular relay is energized, the corresponding status LED 28 may be illuminated to indicate that the connected device is currently activated.

The processor 12 for the control module 10 can be configured to run a selection algorithm 30 that permits the module 10 to emulate a particular type and/or model of controller based on a set of software and hardware configurations stored in a configuration table 32. A unit type selector DIP-switch 34 (e.g. a 4 position DIP-switch) may permit the installer to configure the type of controller to be emulated. The selection of a particular switch setting on the unit type selector DIP-switch 34 causes the processor 12 to access a particular software and hardware configuration stored within the configuration table 32. An address selector DIP-switch 36, in turn, may be used to assign a unique address to the control module 10. The address selector DIP-switch 36 may be utilized, for example, to assign a unique address to the control module 10 that can be identified by an executive controller or other such device connected to the module 10. Although DIP-switches may be used for selecting the controller type and address, it should be understood that other selectors may also be employed. Other types of selectors can include, for example, rotation knobs, slide switches, jumpers, keypads, or a touch screen.

During installation, the selection algorithm 30 for the control module 10 reads the DIP-switch setting selected via the unity type selector DIP-switch 34 and looks up the selection configuration bytes in the configuration table 32. Upon the selection of the desired setting on the DIP-switch 34, the control module 10 can be programmed to automatically configure the input interfaces 20,22 and output interfaces 26,28 to match the inputs and outputs for the components to be controlled. This allows the installer to quickly install the module 10 without having to rewire the input/output connections for the components or to reprogram the software and/or hardware for the module 10. The control module 10 may also run different control algorithms depending on the particular controller type and/or model selected.

Figure 2:
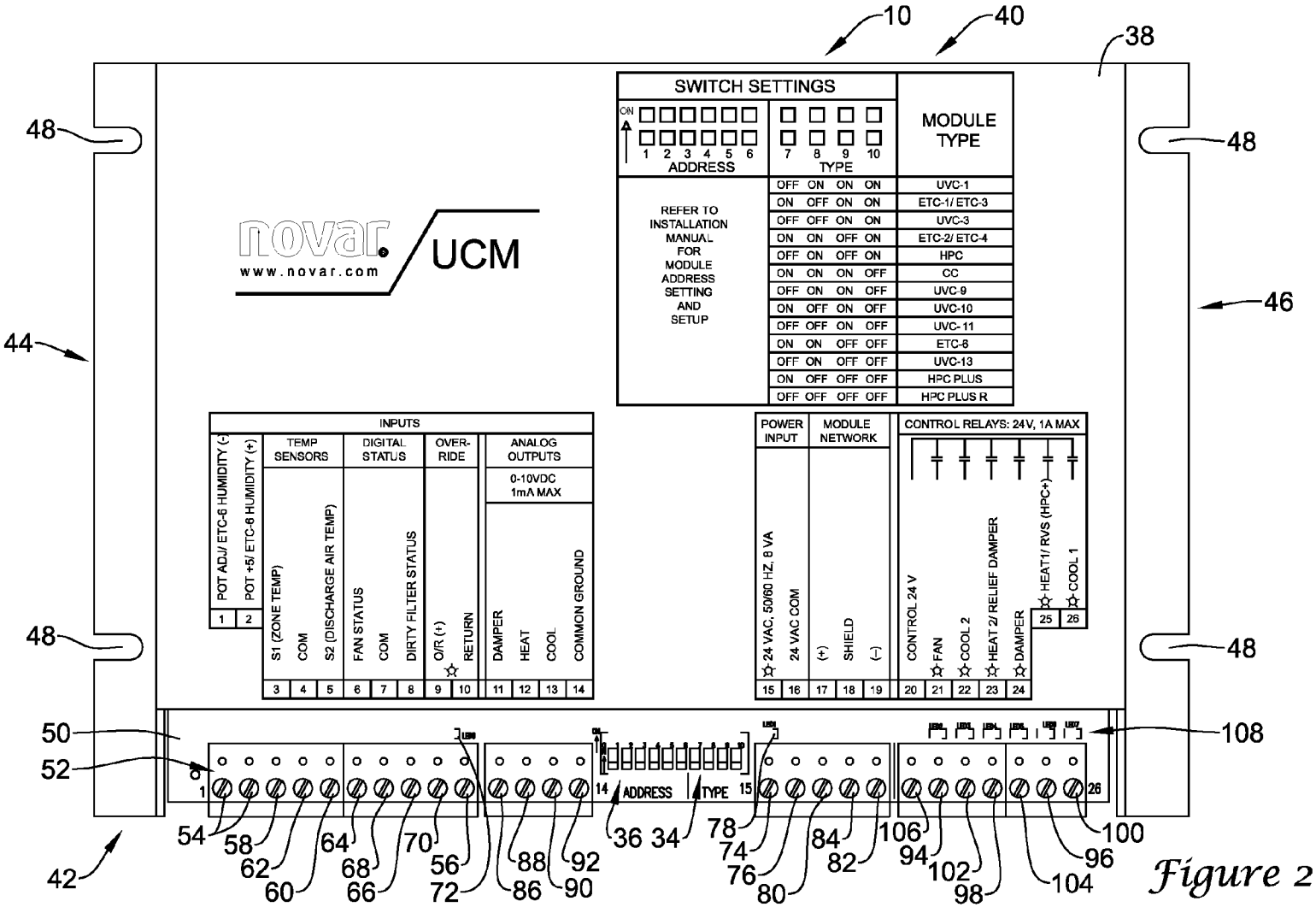
FIG. 2 is a view showing an illustrative field wire configuration for the unitary control module of FIG. 1.

FIG. 2 is a view showing an illustrative field wire configuration for the unitary control module 10 of FIG. 1. As shown in FIG. 2, the control module 10 can include a controller housing 38 having an upper portion 40, a lower portion 42, and a number of sides 44,46. The sides 44,46 of the controller housing 38 can include a number of mounting holes 48 to facilitate surfacing mounting of the control module 10 to a control panel (not shown). The lower portion 42 of the controller housing 38 may expose a portion of an internal circuit board 50 containing the unit type and address selector DIP-switches 34,36 and a terminal strip 52. The terminal strip 52 can include a number of screw connection terminals for connecting various devices to the analog and digital status input interfaces 20,22 and the analog and digital output interfaces 26,28 of the control module 10.

A number of setpoint adjustment terminals 54 and a return terminal 56 can be utilized to connect a setpoint adjustment potentiometer to the control module 10, allowing the setpoints for the module 10 to be adjusted remotely from another device. When the control module 10 is configured for use as an electronic thermostat controller, for example, the setpoint adjustment input terminals 54 and return terminal 56 may be used by a temperature sensor equipped with a temperature setpoint adjustment potentiometer to control the temperature setpoints at a location remote from the control module 10. When the control module 10 is configured as a heat pump controller, ventilation controller, custom controller, or for certain types of electronic thermostat controllers, the setpoint adjustment potentiometer can be disabled, allowing the terminals 54 to be used for connecting other system components. When disabled, for example, the setpoint adjustment input terminals 54 can be used to connect a 4-20 mA humidity sensor to the control module 10. An illustrative algorithm for automatically detecting the connection of an adjustment potentiometer or humidity sensor to the control module 10 is described with respect to FIGS. 4A-4B.

The control module 10 can include a number of analog input terminals for connection to one or more temperature sensors, humidity sensors, or other desired devices. A zone temperature input terminal 58, for example, can be used to connect to a thermistor for remotely sensing the temperature within a particular zone controlled by the control module 10. A discharge air temperature input terminal 60, in turn, can be connected to another thermistor for use in remotely sensing the discharge air temperature from an air supply duct. A common input terminal 62 may provide a common ground for each of the sensor input terminals 58,60.

The terminal strip 52 can further include a number of digital status input terminals for use in providing digital input connections to the control module 10. A fan status input terminal 64, for example, can be used by the control module 10 to determine whether the fan is currently on and is functioning properly. A dirty filter status input terminal 66, in turn, can be used by the control module 10 to indicate whether an installed filter is dirty and requires maintenance or replacement. A common input terminal 68 may provide a common ground for each of the digital status input terminals 64,66.

An override input terminal 70 can be used for connecting the control module 10 to a momentary contact switch that can be activated to override the module 10 at certain periods such as at startup, after a pre-determined period of time has elapsed, and/or based on a command signal received from an executive controller. In some embodiments, for example, the override input terminal 70 may be used to connect a temperature sensor to the control module 10 that functions as an override switch in the event that the temperature exceeds a certain threshold temperature. An example of such sensor is an area temperature sensor having a setpoint adjustment selector for adjusting the temperature setpoint. During an override event, an LED 72 on the circuit board 50 may illuminate, providing a visual indication that normal operation of the control module 10 has been suspended.

A set of power input terminals 74,76 can be used for powering the control module 10 and, in some cases, one or more components connected to the module 10. In certain embodiments, for example, the power input terminals 74,76 can be connected to a 24VAC source for supplying the control module 10 with 24VAC power. A power status LED 78 may be used to provide a visual indication that the control module 10 is currently powered. A number of communications terminals 80,82 on the terminal strip 52 may permit the control module 10 to be networked with another controller such as an executive controller. If necessary, a shielded input terminal 84 different from the other common grounds 62,68 on the terminal strip 52 can be used for shielding the communications terminals 80,82, if necessary.

The terminal strip 52 can further include a number of analog and digital output terminals which can be used to connect the control module 10 to those system components to be controlled. The analog output terminals can include, for example, a damper output terminal 86 for controlling a damper, a heat output terminal 88 for controlling a heating unit such as a forced-air furnace or heat-pump, and a cool output terminal 90 for controlling a cooling unit such as an air conditioner or reversible heat-pump. A common ground terminal 92 may provide a common ground for each of the analog output terminals 86,88,90.

A number of relay output terminals can be used for switching on various system components controlled by the control module 10. A fan relay output terminal 94 can be used for switching on a ventilation fan. A primary heat relay output terminal 96 can be used for switching on a primary heating source such as a reversible heat pump or furnace. A secondary heat relay output terminal 98, in turn, can be used for switching on a secondary or auxiliary heating source such as a heat pump or, alternatively, a relief damper. A primary cool relay output terminal 100 can be used for switching on a primary cooling source such as an air conditioner. A secondary cool relay output terminal 102, in turn, can be used for switching on a secondary cooling source such as a heat pump or evaporative cooler. A damper relay output terminal 104 can be used for switching on a damper valve.

A 24V source terminal 106 may be used for one side of a 24V source to be switched on when one of the relay output terminals 94,96,98,100,102,104 are activated. The relay output terminals 94,96,98,100,102,104 may be isolated from the other connections on the terminal strip 52 to permit an additional power source to be connected via the 24V source terminal 106, if desired. A set 108 of relay output status LED's on the circular board 50 provide a visual indication of the activation status of each of the relays.

The DIP-switches 34,36 provided on the circuit board 50 can be utilized to select the particular type and/or model of controller to be emulated by the control module 10. In certain embodiments, for example, the particular switch settings on the unit type selector DIP-switch 34 can be adjusted in order to configure the control module 10 to function as either a ventilation controller, an electronic thermostat controller, a heat pump controller, a custom controller, or other desired controller. In other types of systems such as a lighting system, the unit type selector DIP-switch 34 can be used to configure the control module 10 to function as either a lighting timer or a security controller, as desired. For each type of controller, the unit type selector DIP-switch 34 can also be configured to select between different models of controllers. The particular controller type selected via the unit type DIP-switch 34 can be configured to match the controller being replaced, including the software and hardware configurations for that particular controller.

An illustrative table showing several unit ventilation controllers (UVC's), electronic thermostat controllers (ETC's), heat pump controllers (HPC's), and a customized controller (CC) that can be emulated based on the unit type DIP-switch setting is reproduced below in Table 1. Table 1 may represent, for example, a table of controller models produced by Novar Controls of Cleveland, Ohio and the corresponding DIP-switch setting for that controller. It should be understood, however, that the control module 10 can be configured to emulate other types and/or models of controllers other than that depicted in Table 1.

TABLE 1

(Model Type DIP-switch Settings)

| Novar Controls Model # | Switch 7 | Switch 8 | Switch 9 | Switch 10 |
|---|---|---|---|---|
| UVC-1 | Off | On | On | On |
| UVC-3 | Off | Off | On | On |
| UVC-10 | On | Off | On | Off |
| UVC-11 | Off | Off | On | Off |
| UVC-13 | Off | On | Off | Off |
| ETC-1/ETC-3 | On | Off | On | On |
| ETC-2/ETC-4 | On | On | Off | On |
| ETC-6 | On | On | Off | Off |
| HPC | Off | On | Off | On |
| HPC Plus | On | Off | Off | Off |
| HPC Plus R | Off | Off | Off | Off |
| CC | On | On | On | Off |

Figure 3:
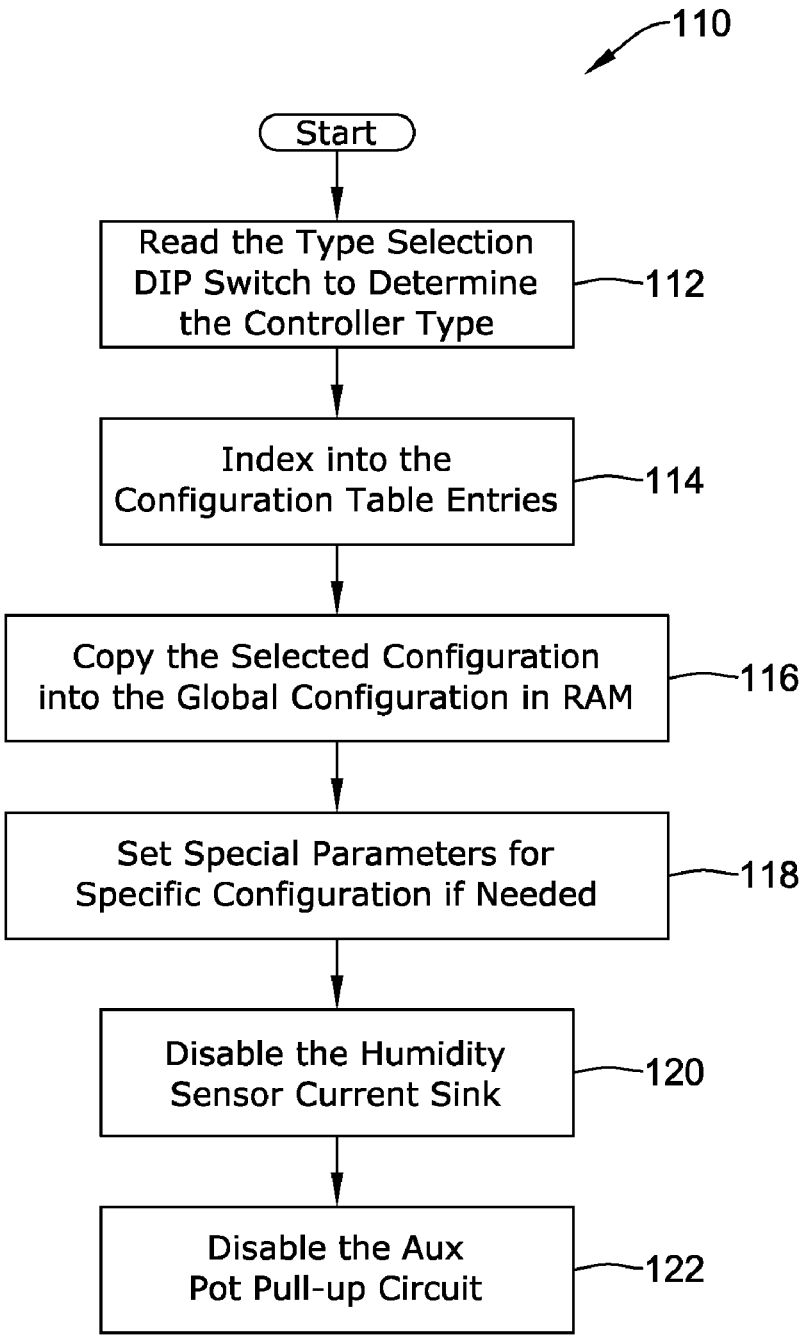
FIG. 3 is a flow chart showing an illustrative method of configuring the unitary control module of FIG. 1 for initial use.

FIG. 3 is a flow chart showing an illustrative method 110 of configuring the unitary control module 10 of FIG. 1 for initial use. The method 110 may begin generally at block 112 when the control module 10 reads the unit type selection DIP-switch 34 setting to determine the type of controller to be installed. The selection of "0101" on the unit type selector DIP-switch 34, for example, may correspond to a heat pump controller (HPC) to be emulated by the control module 10. Once the control module 10 has read the selected controller type via the DIP-switch 34, the module 10 may then index to the corresponding configuration table entries within the configuration table 32, as indicated generally at block 114. Upon indexing the configuration table entries, the control module 10 may then copy the configuration parameters for the selected controller type into a global configuration settings database contained in a storage memory, as indicated generally at block 116. If needed, one or more parameters for a specific configuration can then be adjusted from their default setting, as indicated generally at block 118. If, for example, the installer wishes to modify the control module 10 to accept temperature setpoints from a specific type of temperature sensor not provided for by the default settings, the installer may then reconfigure the module 10 to accept the new sensor input, if necessary.

In some cases, the controller may setup initial conditions so that algorithm can determine the correct configuration starting from a known baseline. For example, and as indicated generally at blocks 120 and 122, the controller may disable a humidity sensor current sink, an auxiliary potentiometer pull-up circuit, and/or setup any other suitable initial condition as desired. Upon configuration, the control module 10 may enable and/or disable various I/O settings in accordance with the software and/or hardware configurations normally provided for by the emulated controller.

Figure 4A:
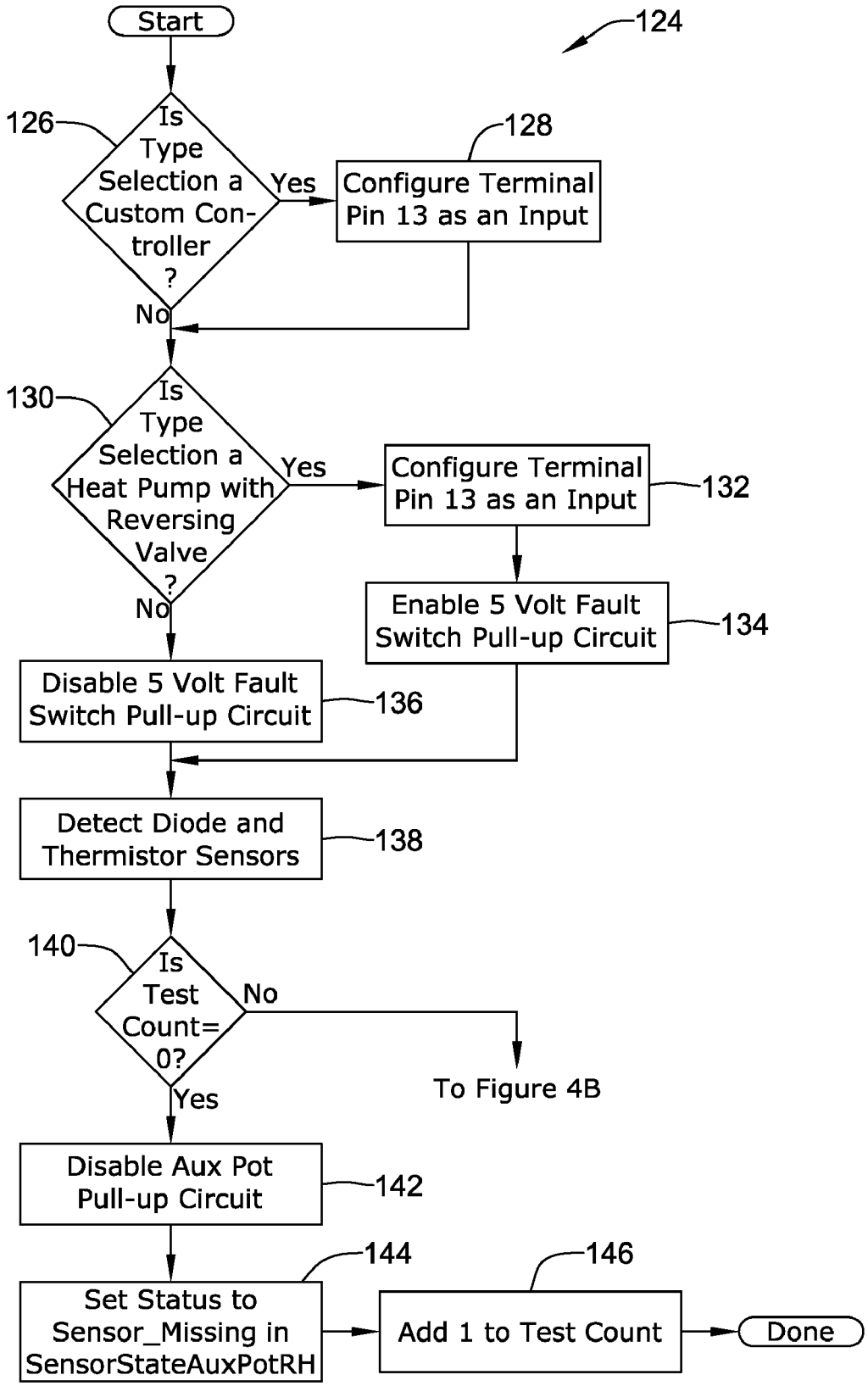
FIGS. 4A-4B is a flow chart showing an illustrative algorithm for automatically detecting the connection of a humidity sensor or an adjustment potentiometer to the control module of FIG. 1.
Figure 4B:
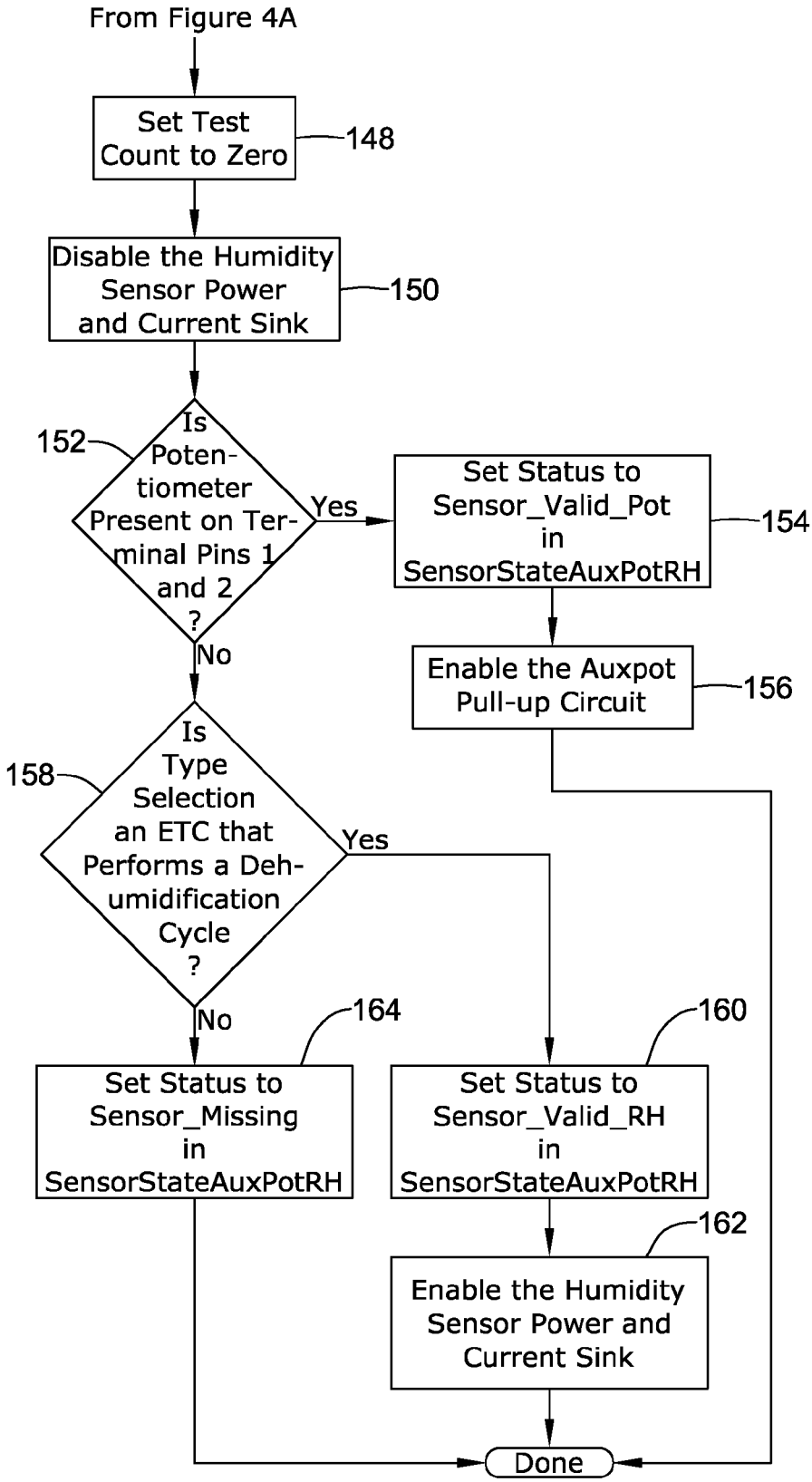

FIGS. 4A-4B is a flow chart showing an illustrative algorithm 124 for automatically detecting the connection of a humidity sensor or an adjustment potentiometer to the control module 10 of FIG. 1. The algorithm 124 can be utilized, for example, for switching the appropriate I/O settings on the control module 10 to read either an auxiliary potentiometer connected to the module 10 or to supply power to a humidity sensor connected to the module 10.

The auto-detection algorithm 124 may begin generally at decision block 126 when the control module 10 reads the unit type selection DIP-switch 34 to determine whether the controller type selected is a custom controller type. If the DIP-switch setting selected indicates that the control module 10 is to function as a custom controller, the analog cooling output terminal 90 (FIG. 2) can be switched to "0", causing the terminal 90 to act as an input, as indicated generally at block 128. This may enable, for example, a feedback potentiometer to be used to sense the position of a damper controlled by the controller.

If at block 126 a custom controller is not selected, the control module 10 may next determine whether the controller type selected is a heat pump controller "HPC Plus" (Tablel 1) which has a reversing valve that energizes with heat, or a heat pump controller "HPC Plus R" which has a reversing valve that energizes with cooling, as indicated generally at decision block 130. If either type of controller has been selected, the analog cooling output terminal 90 can be switched to "0", configuring the terminal 90 to act as an input as indicated generally at block 132. This may enable a general 5V fault switch pull-up circuit within the control module 10 to be used for fault sensing, as indicated generally at block 134. If at decision blocks 126 and 130 the control module 10 is not configured to function as either a custom controller or a heat pump controller equipped with a reversing valve, the module 10 can be configured to disable the 5V fault switch pull-up circuit, as indicated generally at block 136.

At block 138, the control module 10 can be further configured to detect whether any diode and/or thermistor sensors are connected to the module 10. In certain embodiments, for example, the control module 10 can be configured to check for the presence of either a diode sensor or thermistor connected to terminals 58 and/or 60 of the terminal block 52. The control module 10 can be configured to automatically detect the type of sensor connected to the terminals 58,60 and then automatically configure the control module hardware and software to operate using that sensor. If a 10 kΩ thermistor is connected to the zone temperature terminal input 58, for example, the control module 10 can be configured to automatically detect the thermistor and reconfigure the hardware and software settings for the module 10 to operate using the thermistor.

At decision block 140, the control module 10 may next determine whether a current test count value is equal to "0", indicating that there is no humidity sensor currently connected to the module 10. If the current test count read is "0", the control module 10 may disable an auxiliary potentiometer pull-up circuit at block 142 and then set a status message at block 144 indicating that the humidity sensor is missing. The current test count may then be incremented by one, as indicated generally at block 146. If at block 140 the current test count is not equal to "0", the control module 10 may then reset the test count to "0" at block 148 and disable the humidity sensor power and current sink for the humidity sensor, as indicated generally at block 150.

Once disabled, the control module 10 may next determine whether an auxiliary potentiometer has been connected to the setpoint adjustment terminals 54 on the terminal block 52, as indicated generally at decision block 152. If a setpoint adjustment potentiometer is detected, the control module 10 can set a status message at block 154 indicating that the potentiometer is present. The auxiliary pull-up circuit used for activating the setpoint potentiometer can then be enabled, as indicated generally at block 156. If, however, the setpoint adjustment potentiometer is not detected at decision block 152, the control module 10 may then determine whether the type of controller selected is an electronic thermostat controller (e.g. ETC-6 in Table 1) that performs a dehumidification cycle. If so, the control module 10 can set a status message at block 160 indicating that the humidity sensor is present, and then enable the humidity sensor power and current sink at block 162. Enablement of the humidity sensor can occur, for example, when an electronic thermostat controller to be emulated is capable of operating both a heating and cooling stage at the same time during a dehumidification cycle. Otherwise, if the type of controller selected does not utilize the humidity sensor, the control module 10 can be configured to set the sensor status to indicate that the sensor is missing, as indicated generally at block 164.

Figure 5:
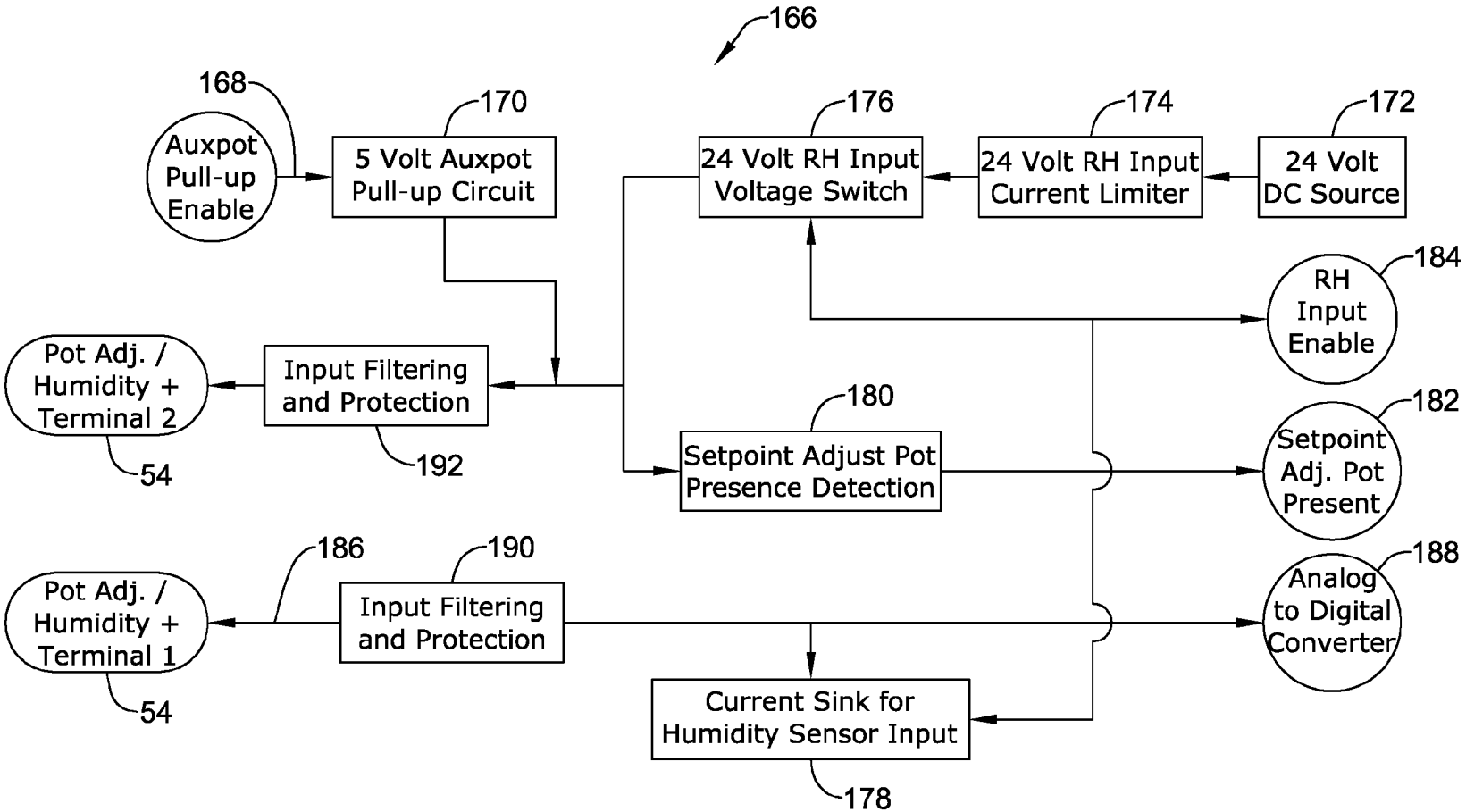
FIG. 5 is a block diagram showing the configuration of the setpoint adjustment terminals for use with either a humidity sensor or an adjustment potentiometer.

FIG. 5 is a block diagram 166 showing the configuration of the setpoint adjustment terminals 54 for use with either a humidity sensor or an adjustment potentiometer. When a humidity sensor is connected to the setpoint adjustment terminals 54 and is detected by the sensor auto-detect algorithm 124 described above with respect to FIG. 4, the control module 10 may send a signal 168 causing a 5V pull-up circuit 170 to activate. Otherwise, if no humidity sensor is present or is disabled, the 5V pull-up circuit 170 is not activated and the control module 10 then determines at block 180 whether a setpoint adjustment potentiometer is present on the terminals 54. If the potentiometer is present, a flag 182 may be set indicating that a potentiometer is connected to the terminals 54.

A 24VDC power source 172 connected to a current limiter 174 and a switch 176 may be used to provide 24VDC power to the each of the setpoint adjustment terminal inputs 54 for powering the humidity sensor when present and enabled. A current sink 178 may be provided as a drain if the type of humidity sensor is current-loop humidity sensor. In use, the switch 176 and current sink 178 may be switched-on via an RH input signal 184 received from the processor 12. The determination of whether the processor 12 sends a signal 182 activating the switch 176 and enabling the current sink 178 will typically depend on the particular type of controller emulated. This is illustrated, for example, at decision block 158 in FIG. 4B when the control module 10 determines whether the controller selected is an electronic thermostat controller that performs a dehumidification cycle.

During operation, analog signals 186 received from either the adjustment potentiometer or the humidity sensor via the input terminals 54 can be fed to an A/D converter 188 for further processing by the processor 12. As indicated by blocks 190 and 192, the signals 186 received from either the adjustment potentiometer or the humidity sensor may also be subjected to filtering and can be protected against voltage surges or spikes using a suitable suppression device such as a spark gap. Using these signals 186, the control module 10 can then control the system components based on the software and hardware settings for the particular controller type selected.

Having thus described several embodiments of the present invention, those of skill in the art will readily appreciate that other embodiments may be made and used which fall within the scope of the claims attached hereto. It will be understood that this disclosure is, in many respects, only illustrative. Changes can be made with respect to various elements described herein without exceeding the scope of the invention.

What is claimed is:

1. A unitary control module configured to selectively emulate a plurality of different controller types, comprising:

an input interface having one or more input terminals including an analog input interface that has setpoint input terminals for connection to either a humidity sensor or an adjustment potentiometer;

an output interface having one or more output terminals;

a unit type selector for selecting between a number of controller type settings; and a controller having stored therein a plurality of configurations for a plurality of controller types, wherein the configurations include algorithms, the controller configured to run a selected algorithm for configuring the input terminals and/or the output terminals based at least in part on the selected controller type setting.

2. The control module of claim 1, wherein the control module is configured to automatically detect the connection of the humidity sensor or adjustment potentiometer to the setpoint input terminals.

3. The control module of claim 1, wherein the input interface further includes a digital input interface.

4. The control module of claim 1, wherein the unit type selector is a DIP-switch.

5. The control module of claim 1, wherein the control module further includes an address selector.

6. The control module of claim 1, wherein the selected algorithm is adapted to automatically configure the input and/or output terminals to match the configuration of one or more system components connected to the input and output terminals.

7. The control module of claim 1, wherein the controller is configured to run a different control algorithm based on the controller type setting selected via the unit type selector.

8. A unitary control module configured to selectively emulate a plurality of different controller types, comprising:

an input interface having one or more input terminals;

an output interface having one or more output terminals, wherein the output interface includes an analog output interface and a relay output interface;

a unit type selector for selecting between a number of controller type settings; and a controller having stored therein a plurality of configurations for a plurality of controller types, wherein the configurations include algorithms, the controller configured to run a selected algorithm for configuring the input terminals and/or the output terminals based at least in part on the selected controller type setting.

9. A unitary control module configured to selectively emulate a plurality of different controller types, comprising:

an input interface having one or more input terminals;

an output interface having one or more output terminals;

a unit type selector for selecting between a number of controller type settings;

a controller having stored therein a plurality of configurations for a plurality of controller types, wherein the configurations include algorithms, the controller configured to run a selected algorithm for configuring the input terminals and/or the output terminals based at least in part on the selected controller type setting; and wherein the unitary control module is an HVAC controller.

10. A method of configuring an HVAC controller, comprising:

providing a unitary control module having an input interface with one or more input terminals, an output interface with one or more output terminals, a unit type selector switch for selecting between a number of controller type settings, and a controller having stored therein a configuration table containing a plurality of configuration parameters associated with a plurality of controller types;

reading a controller type setting from the selector switch;

indexing to the configuration table for the controller type setting read from the selector switch;

copying the configuration parameters for the selected controller type into a storage memory;

configuring the input and/or output terminals for the control module using the stored configuration parameters associated with the controller type setting selected; and controlling one or more system components connected to the input and output terminals.

11. The method of claim 10, wherein the controller type setting is user-selected.

12. The method of claim 10, further comprising the step of automatically detecting the connection of a system component to the input interface and/or output interface.

13. The method of claim 12, wherein the step of automatically detecting the connection of a system component to the input interface and/or output interface includes detecting the presence of either a humidity sensor or an adjustment potentiometer connected to the control module.

14. The method of claim 10, wherein each of the controller type settings correspond to a different control algorithm executable by the control module.

15. A unitary control module configured to selectively emulate a plurality of different controller types, comprising:

an input interface having one or more input terminals;

an output interface having one or more output terminals;

a unit type selector for selecting between a number of controller type settings;

a controller having stored therein a plurality of configurations for a plurality of controller types, wherein the configurations include algorithms, the controller configured to run a selected algorithm for configuring the input terminals and/or the output terminals based at least in part on the selected controller type setting; and wherein when the unit type selector selects a first controller type setting, the input and output terminals are configured to communicate with a first type of controlled equipment, and when the unit type selector selects a second controller type setting, the same input and output terminals are configured to communicate with a second type of controlled equipment.

16. The control module of claim 15, wherein the control module is configured to emulate one or more of a ventilation controller, an electronic thermostat controller, a heat pump controller, and a custom controller.

* * * * *